US007073682B2

(12) United States Patent
Raches et al.

(10) Patent No.: US 7,073,682 B2
(45) Date of Patent: Jul. 11, 2006

(54) SNAP ASSEMBLY DISHWASHER BASKET

(75) Inventors: Scott D. Raches, Jackson, TN (US); Wayne M. VanLandingham, Jackson, TN (US)

(73) Assignee: Maytag Corporation, Newton, IA (US)

( * ) Notice: Subject to any disclaimer, the term of this patent is extended or adjusted under 35 U.S.C. 154(b) by 61 days.

(21) Appl. No.: 10/299,113

(22) Filed: Nov. 19, 2002

(65) Prior Publication Data

US 2004/0094555 A1 May 20, 2004

(51) Int. Cl.
*B65D 6/08* (2006.01)

(52) U.S. Cl. ..... 220/488; 220/615; 220/668; 220/676; 220/691

(58) Field of Classification Search ..... 220/476, 220/487, 488, 4.21, 615, 668, 691, 4.28, 220/4.33, 676; 211/41.3, 41.8; 312/228.1; 248/37.3; 134/200
See application file for complete search history.

(56) References Cited

U.S. PATENT DOCUMENTS

| | | | | | |
|---|---|---|---|---|---|
| 2,710,617 | A | * | 6/1955 | James et al. | 134/183 |
| 3,236,410 | A | * | 2/1966 | Swartz | 220/62 |
| 3,295,713 | A | * | 1/1967 | Optner | 220/840 |
| 3,665,943 | A | * | 5/1972 | Lampman et al. | 134/200 |
| D254,187 | S | | 2/1980 | Freese | |
| 4,324,172 | A | * | 4/1982 | Cazals et al. | 99/277.1 |
| 5,069,360 | A | | 12/1991 | Dingler et al. | |
| 5,287,984 | A | | 2/1994 | Michael | |
| 5,431,294 | A | | 7/1995 | Stottmann et al. | |
| 5,588,549 | A | * | 12/1996 | Furtner | 220/7 |
| D391,696 | S | | 3/1998 | Bournay, Jr. et al. | |
| 5,881,906 | A | | 3/1999 | Rogers et al. | |
| 6,089,366 | A | * | 7/2000 | Cheng | 206/192 |
| 6,401,950 | B1 | * | 6/2002 | Chiang | 220/1.5 |
| 2002/0162838 | A1 | * | 11/2002 | Leaphart et al. | 220/4.21 |

FOREIGN PATENT DOCUMENTS

| | | | |
|---|---|---|---|
| DE | 196 24 888 | * | 6/1996 |
| JP | 5-115420 | | 5/1993 |

* cited by examiner

*Primary Examiner*—Jes F. Pascua
(74) *Attorney, Agent, or Firm*—McKee, Voorhees & Sease, P.L.C.

(57) ABSTRACT

A dishwasher silverware basket is provided with a cage and a back wall which are snap-fit together. The cage includes a front wall, opposite side walls, and a bottom wall. The cage and back wall are both provided with mating hooks and openings which snap-fit together to form the silverware basket. In assembling the cage and back wall, hooks on the cage are fit into openings in the back wall. The cage is then moved toward the back wall so that second hooks on the back wall snap-fit into openings or recesses in the cage so as to form a permanent basket. Finally, the cage is moved downwardly with respect to the back wall so that the hooks on the cage engage with the lower edge portions of the back wall openings. Dividers may be provided in the basket to define compartments therein. The basket can be mounted on the interior surface of the dishwasher door via slots in the back wall, or can be set within a rack in the dishwasher.

9 Claims, 4 Drawing Sheets

SNAP ASSEMBLY DISHWASHER BASKET

BACKGROUND OF THE INVENTION

Silverware baskets for dishwashing machines take many shapes and forms. Some baskets sit within a rack in the dishwasher, while other baskets mount on the inside surface of the dishwasher door. The silverware baskets typically are formed of molded plastic or plastic-coated wires. The shape of prior art baskets is normally limited by space constraints within the door and the rack. Some baskets are provided with a lid or front wall which is pivotal between open and closed positions, with a latch provided to maintain the lid in a closed position during the washing operation.

Prior art baskets often are formed by molding as one-piece structures, which requires drafting of the sidewalls, so that the basket can be removed from the mold. Such drafting reduces usable space within the basket.

Therefore, a primary objective of the present invention is the provision of an improved silverware basket for dishwashers.

Another objective of the present invention is the provision of a dishwasher silverware basket made of two molded pieces snap fit together to form the basket.

Another objective of the present invention is a provision of a dishwasher basket made of two pieces which are quickly and easily assembled to form the final basket structure.

Still another objective of the present invention is the provision of a method of assembling dishwasher basket components through quick and permanent snap fitting.

A further objective of the present invention is the provision of a molded dishwasher silverware basket which mounts on the inner surface of the dishwasher door.

Another objective of the present invention is the provision of a dishwasher silverware basket which is economical to manufacture and durable in use.

These and other objectives will become apparent from the following description of the invention.

BRIEF SUMMARY OF THE NVENTION

The silverware basket of the present invention is formed with two molded plastic pieces snap fit together to form the basket. The first piece is a cage having a front wall, opposite sidewalls, and a bottom wall. The second piece is a back wall. The cage and the backwall have mating male and female members which snap fit together to form a four-sided basket with an open top and a closed bottom for holding silverware. One or more dividing walls may be provided in the basket to form compartments therein.

To assemble the silverware basket, the cage includes a first plurality of male hooks which are received within female openings in the back wall. The cage is then moved toward the back wall so that a second plurality of male hooks on the back wall snap-fit into female openings in the cage. Finally, the cage is moved downwardly with respect to the back wall so that the male hooks on the cage engage with the lower edge portions of the female openings.

DETAILED DESCRIPTION OF THE INVENTION

Figure 1:
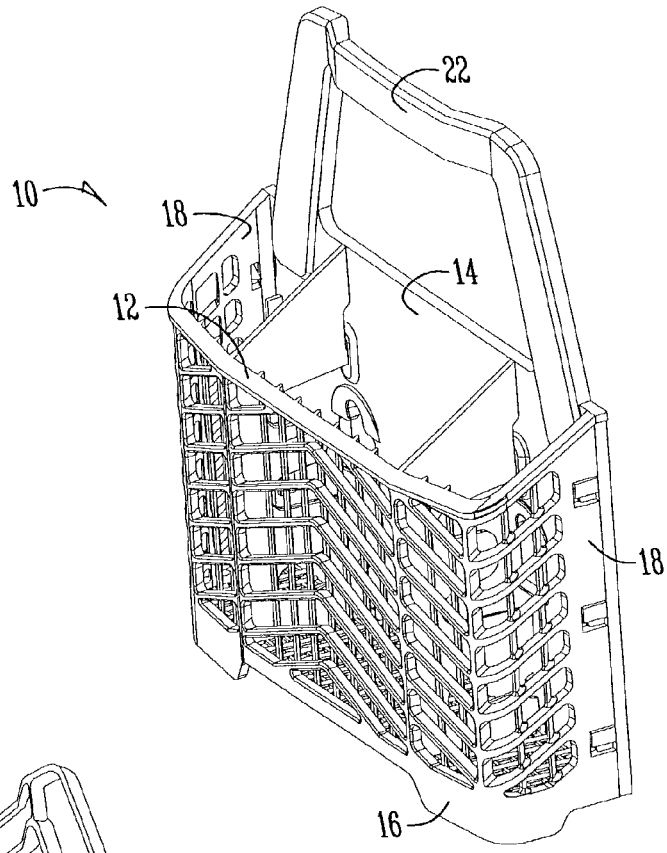
FIG. 1 is a front perspective view of the dishwasher silverware basket of the present invention.
Figure 2:
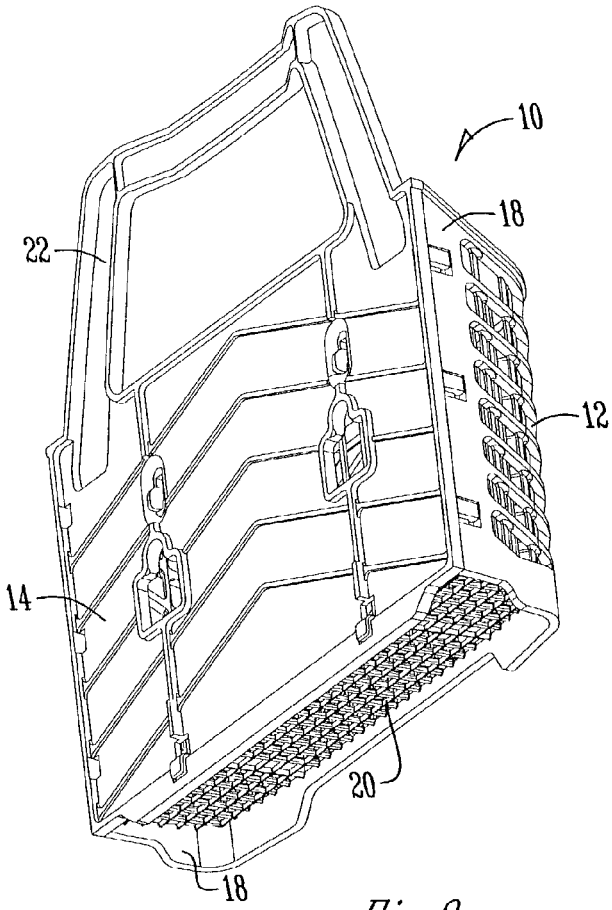
FIG. 2 is a rear perspective view of the silverware basket.
Figure 3:
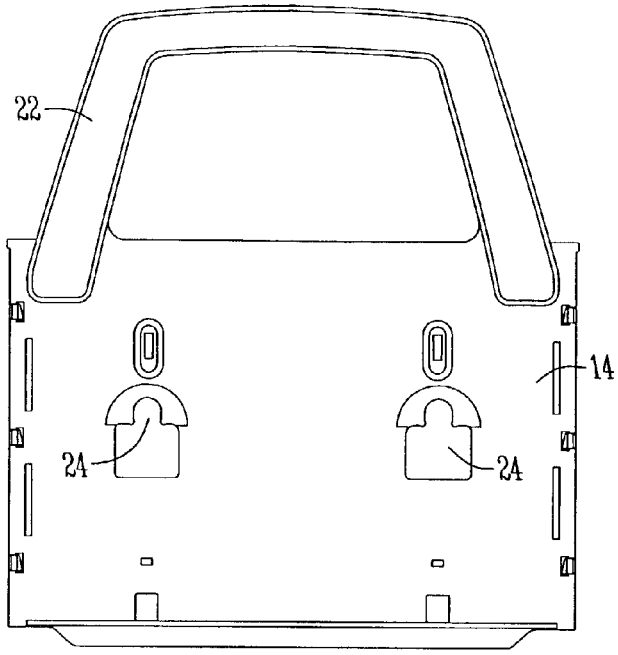
FIG. 3 is a rear elevation view of the back wall of the silverware basket.
Figure 4:
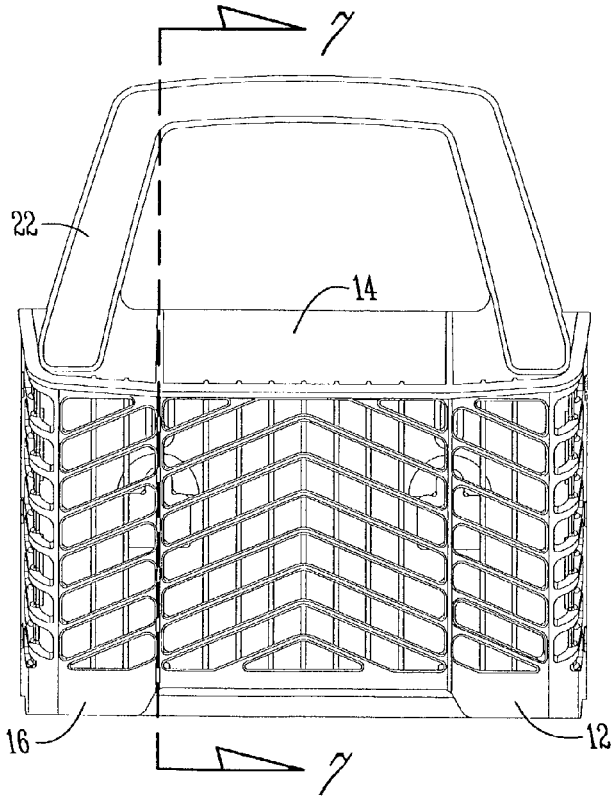
FIG. 4 is a front elevation view of the silverware basket.

The reference numeral 10 generally designates the dishwasher silverware basket of the present invention. The basket 10 comprised of two pieces, the cage 12 and the back wall 14. The cage 12 includes a front wall 16, opposite sidewalls 18, and a bottom wall 20. The back wall 14 includes a handle 22. The back wall 14 also includes a pair of slots 24 so that the basket 10 can be mounted on hooks (not shown) on the inside surface of the dishwasher door. The basket 10 may also be set within a dishwasher rack.

Figure 5:
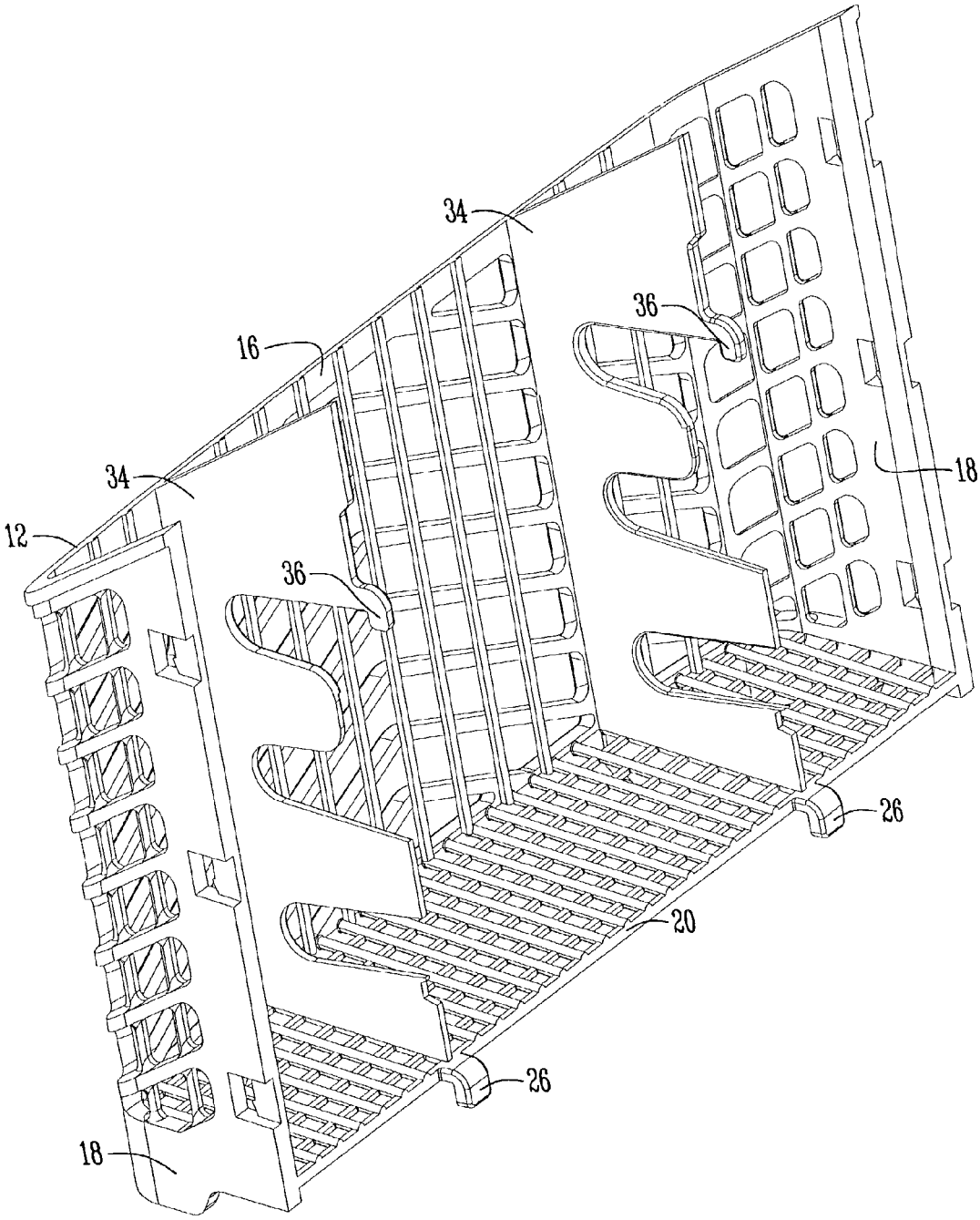
FIG. 5 is a rear perspective of the cage of the silverware basket.
Figure 6:
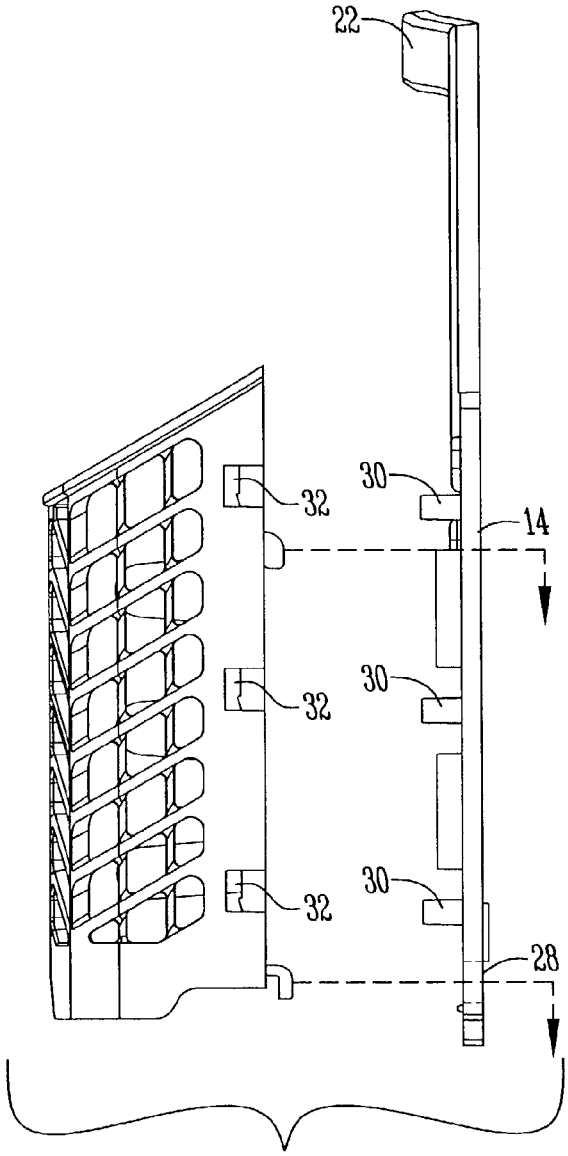
FIG. 6 is a side elevation view of the disassembled cage and back wall components of the silverware basket.
Figure 7:
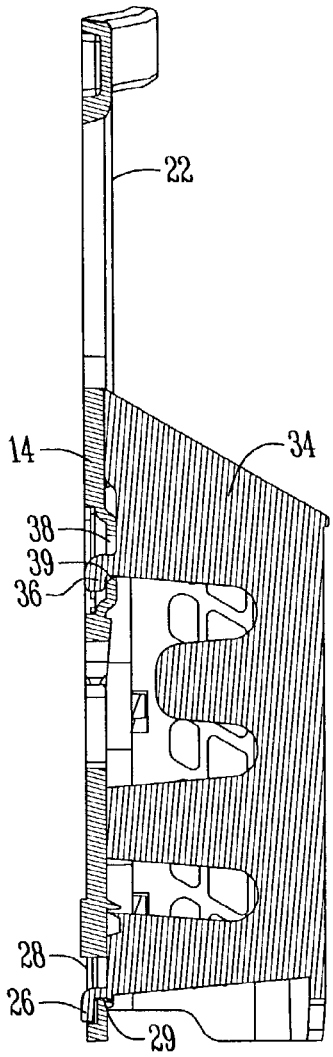
FIG. 7 is a sectional view taken along lines of 7—7 of FIG. 4.

The cage 12 includes a pair of hooks 26 on the rearward edge of the bottom wall 20, as best seen in FIGS. 5–7. The hooks 26 are adapted to be received in openings or holes 28 in the lower edge of the backwall 14.

As shown in FIG. 6, the backwall 14 includes one or more hooks 30 extending forwardly from the opposite sides for receipt in corresponding openings or holes 32 along the rearward edges of the sidewalls 18. It is understood that holes 32 may be formed as recesses defining a shoulder for retentively engaging the hooks 30 on the back wall 14.

The cage 12 may also be provided with one or more dividers 34, as best seen in FIGS. 1 and 5, so as to define separate compartments within the basket 10. The dividers 34 include a hook 36 adapted to be received within an opening or hole 38 in the back wall 14, as shown in FIG. 7.

Preferably, the cage 12 and back wall 14 are injection molded. By molding two separate pieces, drafting depthwise, as in one piece molded baskets, is eliminated and minimal draft is required on walls 18 and 20.

In assembling the cage 12 and the back wall 14, the hooks 26 on the bottom wall 20 of the cage 12 and hooks 36 on the dividers 34 are inserted into the openings 28 and 38 in the back wall 14. The cage 12 is then moved toward the back wall 14 so that the hooks 30 of the back wall 14 then snap-fit into the holes 32 on the sidewalls 18 of the cage 12. Finally, the cage 12 is shifted downwardly with respect to the back wall 14 so that the hooks 26 and 36 on the dividers 34 are retentively received in the holes 28 and 38 in the back wall 14 with hooks 26 and 36 bearing on edges 29 and 39 of the holes 28 and 38 to provide support for the silverware load. Thus, the cage 12 and the back wall 14 quickly and easily snap-fit together so as to form the basket 10. Once assembled, the basket 10 is ready to be mounted on the dishwasher door or set within a rack in the dishwasher for holding silverware and other utensils to be washed. It is not intended that the cage 12 and back wall 14 be separated or disassembled after the initial assembly.

The invention has been shown and described above with the preferred embodiments, and it is understood that many modifications, substitutions, and additions may be made which are within the intended spirit and scope of the invention. From the foregoing, it can be seen that the present invention accomplishes at least all of its stated objectives.

What is claimed is:

1. A dishwasher silverware basket comprising:

a cage having a front wall, opposite side walls, a bottom wall, and an open back;

a back wall adapted to snap fit onto the cage to form a four-sided basket with an open top and a closed bottom for holding silverware;

the bottom wall includes hooks and the back wall has openings adapted to receive the hooks of the bottom wall; and the back wall has opposite edges with hooks and the side walls have openings to receive the hooks of the back wall.

2. The silverware basket of claim 1 wherein the back wall includes slots for mounting the basket in the dishwasher.

3. The silverware basket of claim 1 further comprising at least one divider in the basket to define compartments within the basket.

4. The silverware basket of claim 3 wherein the divider is integrally formed with the cage.

5. The silverware basket of claim 3 wherein the divider includes a male member and the back wall includes a female member to receive the male member of the divider.

6. The silverware basket of claim 1 further comprising a handle.

7. The silverware basket of claim 6 wherein the handle is on the back wall.

8. The silverware basket of claim 1 having at least one compartment within the basket for orienting the silverware in an upright direction.

9. The silverware basket of claim 1 wherein the cage and the back wall are two separate components.

* * * * *